US011122865B2

(12) United States Patent
Burt et al.

(10) Patent No.: US 11,122,865 B2
(45) Date of Patent: Sep. 21, 2021

(54) SYSTEMS AND METHODS FOR A ROTARY CLOSURE

(71) Applicant: Pride Manufacturing Company, LLC, Brentwood, TN (US)

(72) Inventors: John Robert Burt, Brentwood, TN (US); Lee Paul Shuttleworth, Brentwood, TN (US)

(73) Assignee: Pride Manufacturing Company, LLC, Brentwood, TN (US)

( * ) Notice: Subject to any disclaimer, the term of this patent is extended or adjusted under 35 U.S.C. 154(b) by 35 days.

(21) Appl. No.: 16/579,570

(22) Filed: Sep. 23, 2019

(65) Prior Publication Data

US 2020/0345107 A1 Nov. 5, 2020

Related U.S. Application Data

(60) Provisional application No. 62/843,289, filed on May 3, 2019.

(51) Int. Cl.

| | |
|---|---|
| ***A43C 11/16*** | (2006.01) |
| ***A43C 7/00*** | (2006.01) |
| ***A43C 11/22*** | (2006.01) |
| ***A43C 17/02*** | (2006.01) |

(52) U.S. Cl.

CPC ..... *A43C 11/165* (2013.01); *A43C 7/00* (2013.01); *A43C 11/22* (2013.01); *A43C 17/02* (2013.01)

(58) Field of Classification Search

CPC ..... A43C 11/165; A43C 11/22; A43C 11/20; A43C 7/00; A43C 17/02

See application file for complete search history.

(56) References Cited

U.S. PATENT DOCUMENTS

| | | | | |
|---|---|---|---|---|
| 9,072,341 | B2 * | 7/2015 | Jungkind | A43C 11/165 |
| 9,681,705 | B2 * | 6/2017 | Trudel | A43C 7/00 |
| 2014/0359981 | A1 * | 12/2014 | Cotterman | A43C 11/20 24/712.9 |
| 2015/0014463 | A1 * | 1/2015 | Converse | A43C 11/165 242/396.1 |
| 2016/0120267 | A1 * | 5/2016 | Burns | A43C 11/165 24/68 C |
| 2017/0303643 | A1 * | 10/2017 | Converse | A43C 11/1406 |
| 2018/0160775 | A1 * | 6/2018 | Pollack | A43C 7/00 |

FOREIGN PATENT DOCUMENTS

| | | | |
|---|---|---|---|
| CN | 108451098 | A | 8/2018 |
| KR | 101053551 | B1 | 8/2011 |
| WO | 2014098439 | A1 | 6/2014 |
| WO | 2015003079 | A1 | 1/2015 |
| WO | 2018101588 | A1 | 6/2018 |

OTHER PUBLICATIONS

International Search Report and Written Opinion issued in PCT/2019/052478 dated Jan. 27, 2020, 12 pages.

* cited by examiner

*Primary Examiner* — Robert Sandy
*Assistant Examiner* — Rowland Do
(74) *Attorney, Agent, or Firm* — Polsinelli PC; Ari M. Bai

(57) ABSTRACT

A rotary closure with a latching system that latches together the components of the rotary closure in a snap-fit engagement is disclosed. The latching system includes a latching extension defining first and second legs each defining a respective tang configured for coupling the latching extension to the distal-most keyway for assembling the components of the rotary closure together.

19 Claims, 17 Drawing Sheets

SYSTEMS AND METHODS FOR A ROTARY CLOSURE

CROSS REFERENCE TO RELATED APPLICATIONS

This is a non-provisional application that claims benefit from U.S. provisional application Ser. No. 62/843,289 filed on May 3, 2019, which is incorporated by reference in its entirety.

FIELD

The present disclosure generally relates to a latching system for latching together components of an apparatus, and in particular to methods and systems for latching together the various components of a rotary closure for a shoe.

BACKGROUND

A rotary closure system for a shoe, especially for a sports shoe, may comprise a housing which can be attached to the shoe, a tensioning roller which is rotatably supported around the axis of the housing, wherein a tensioning element can be spooled during lacing of the shoe on the tensioning roller element, and a rotary knob which is arranged rotatably around the axis at the housing to turn the tensioning roller for tightening the lacing of the shoe.

A typical rotary closure system functions to lace a shoe by first lacing the tensioning element (lace thread or wire) by rotation of the rotary knob with low torque while maintaining high tension. On the other hand, an easy slacking of the tensioning element for loosening the lace should also be possible when the shoe needs to be taken off again.

It is detrimental that the above requirements of these conventional rotary closure systems cannot be fulfilled collectively without problems. For example, rotary closure systems which fulfill the mechanical requirements of lacing a shoe are often designed so complex that an expensive production with relatively many parts is a given such that assembly of these various components can be difficult and time consuming during manufacturing. For example, latching the components of the rotary closure together during assembly can be complex and expensive.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
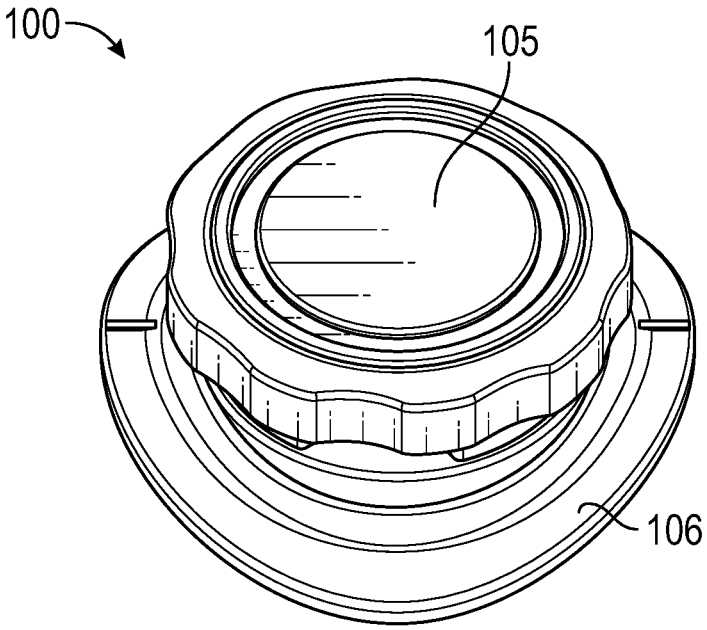
FIG. 1 is a top perspective view of an embodiment of a rotary closure having a latching system for latching together components of the rotary closure.

Various embodiments of a rotary closure having a latching system including a latching component inserted through a plurality of aligned keyways for co-axially mounted components of the rotary closure used with a shoe to latch the assembled components together during manufacturing are disclosed. In some embodiments, the latching system includes a latching extension having an axially extending latching element defining a bifurcated tab portion formed at the free end thereof configured to be inserted through the plurality of aligned keyways of the co-axially mounted components of the rotary closure such that the bifurcated tab portion assumes a locked position once fully inserted through and engaged with a distal-most keyway of the plurality of aligned circular-shaped keyways. In some embodiments, the bifurcated tab portion of the latching element may define a first leg formed opposite a second leg with a slot defined between the first and second legs that allows the first and second legs to be brought together in a biased state when inserted through distal-most keyway such that the bifurcated tab portion assumes a snap-fit engagement with the distal-most keyway. In this arrangement, the latching extension is in a locked position and the components of the rotary closure assume an assembled latched state. Referring to the drawings, an embodiment of a rotary closure for a shoe is illustrated and generally indicated as 100 in FIGS. 1-34.

Figure 2:
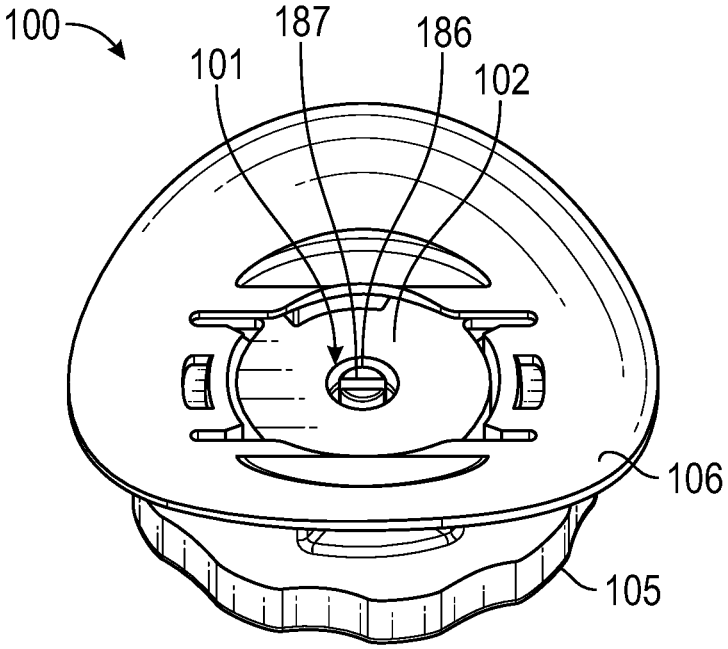
FIG. 2 is a bottom perspective view of the rotary closure of FIG. 1.
Figure 3:
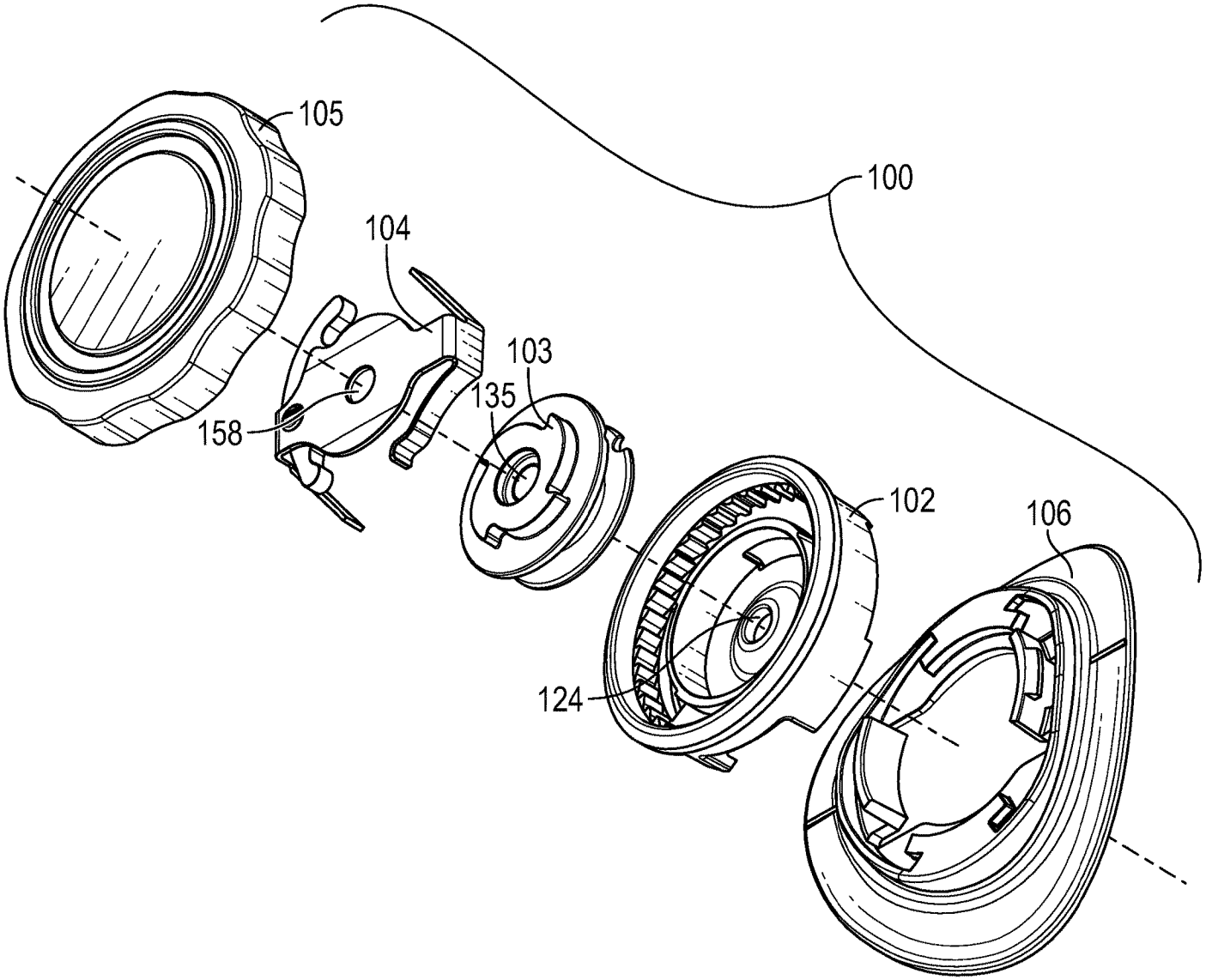
FIG. 3 is an exploded view of the rotary closure of FIG. 1.
Figure 4:
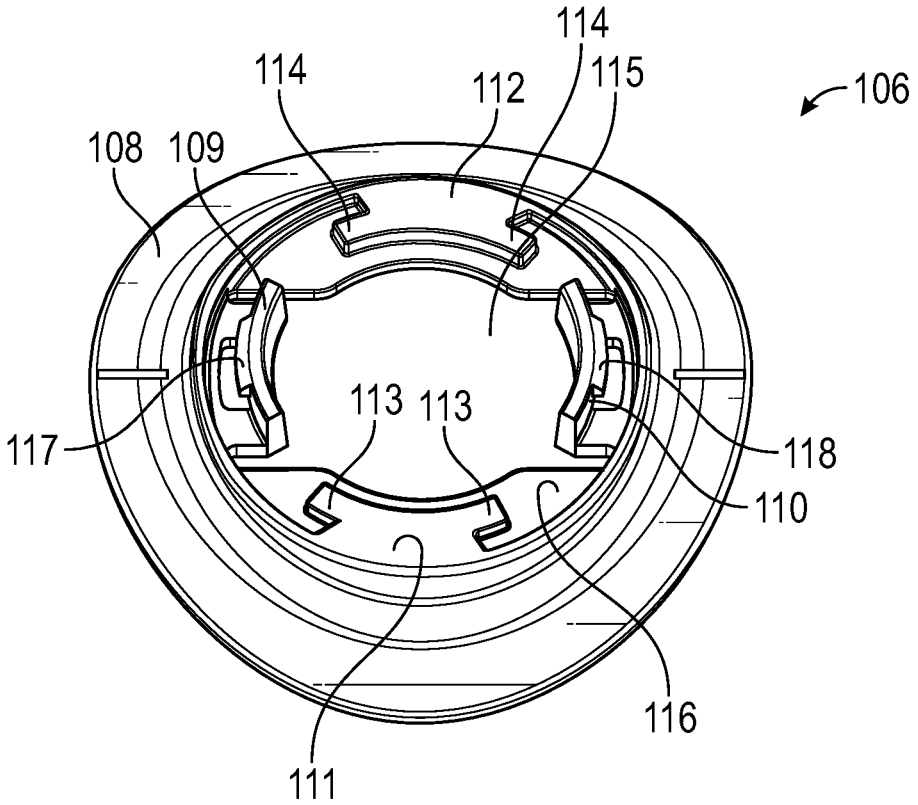
FIG. 4 is a top perspective view of the flange for the rotary closure of FIG. 1.
Figure 5:
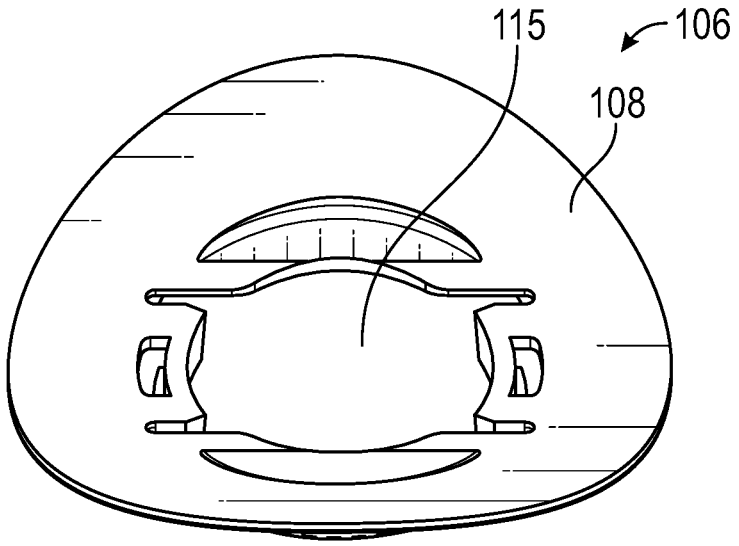
FIG. 5 is a bottom perspective view of the flange.
Figure 7:
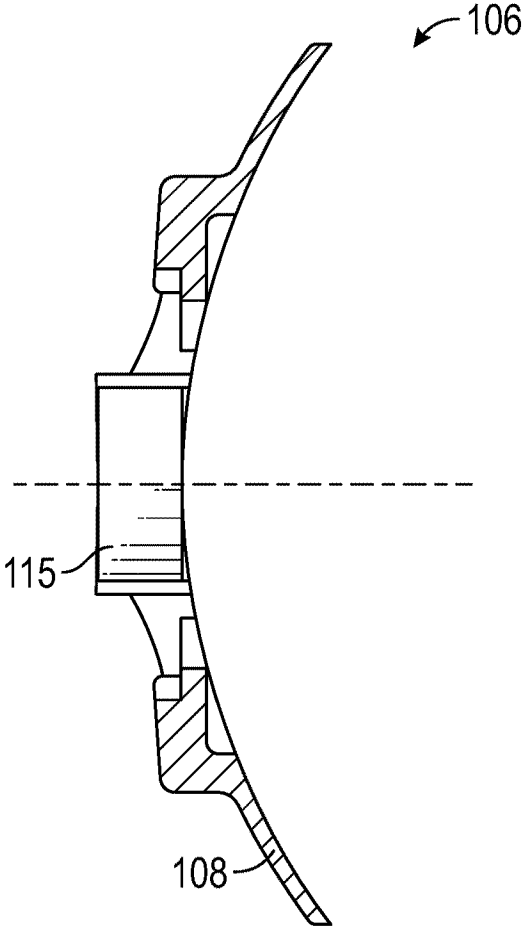
FIG. 7 is a cross-sectional view of the flange taken along line 7-7 of FIG. 6.

FIGS. 1-8 illustrate a rotary closure 100 in an assembled state with a latching system 101 maintaining the components of the rotary closure 100 in a latched condition such that these components are secured together in the assembled state. In one embodiment as shown in FIG. 3, the rotary closure 100 includes a housing 102 in which a spool component 103 is disposed therein as well as a snap spring assembly 104 which is in operative engagement with the spool component 103. In addition, a dial component 105 is operatively engaged with the snap spring assembly 104 to allow for incremental rotation of the dial component 105 in one rotational direction only while preventing rotation of the dial component 105 in the opposite rotational direction. As shown in FIGS. 2 and 3, the dial component 105 forms an axially extending latching extension 186 having a latching element 187 configured to be inserted through a plurality of respective keyways 124, 135 and 158 (FIG. 3) formed axially by the co-alignment of the snap spring assembly 104, spool component 103, and housing 102, respectfully, after assembly. The assembled dial component 105, snap spring assembly 104, spool component 103 and housing 102 may then be coupled to a flange 106, which has been secured along an exterior portion of a shoe (not shown) to complete assembly.

Figure 6:
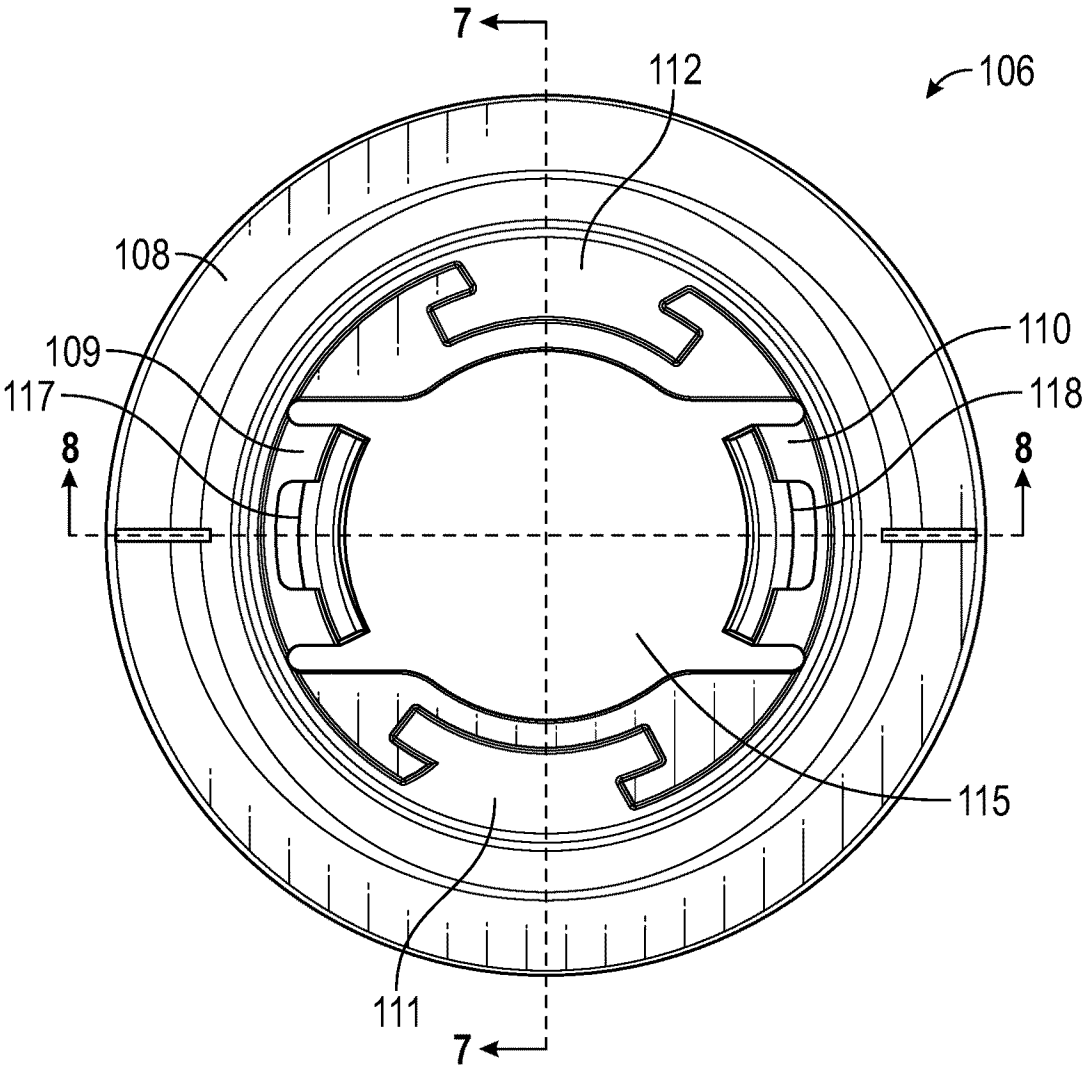
FIG. 6 is a top plan view of the flange.
Figure 8:
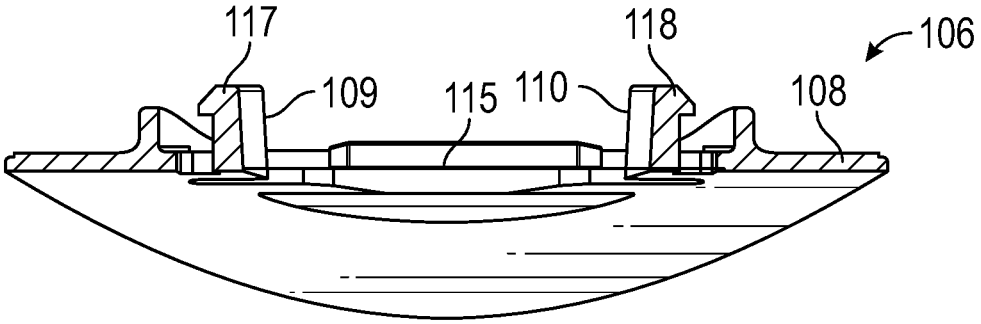
FIG. 8 is a cross-sectional view of the flange taken along line 8-8 of FIG. 6.
Figure 9:
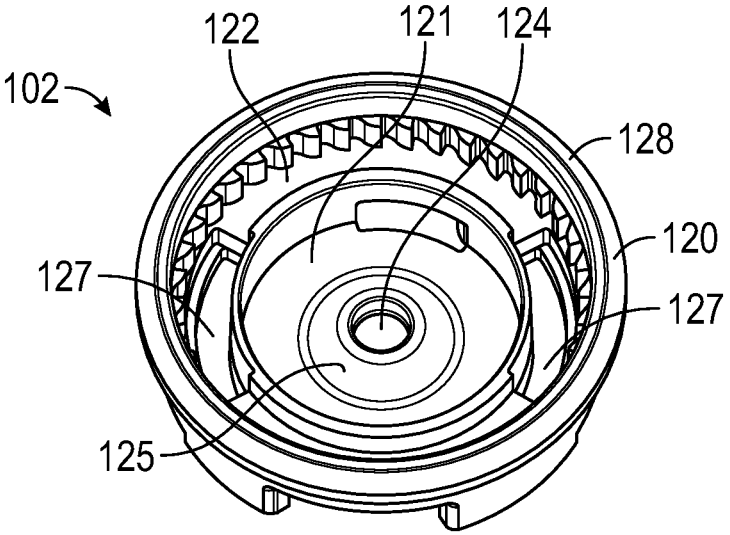
FIG. 9 is a top perspective view of a housing for the rotary closure of FIG. 1.

Referring to FIGS. 4-8, in same embodiments the flange 106 is configured to couple the previously assembled components of the rotary closure 100 to the shoe by engagement with the housing 102. In some embodiments, the flange 106 defines a body 108 having a circular shape with a bowed cross section forming a receptacle 116 on one side that is configured to engage the housing 102 during assembly. The receptacle 116 surrounds an axial opening 115 formed through the body 108 and includes a first retention member 109 formed opposite a second retention member 110 configured to engage opposite sides of the housing 102 to the flange 106. In some embodiments, the receptacle 116 further includes a first engagement member 111 formed opposite a second engagement member 112 in juxtaposition relative to the first and second retention members 109 and 110 formed circumferentially around the axial opening 115 and extending laterally inward as shown in FIG. 6. In some embodiments, the first and second retention members 109 and 110 form first and second tang portions 117 and 118, respectively, at the free ends thereof. The first and second tang portions 117 and 118 are configured to couple with the housing 102 in a snap fit engagement.

Figure 10:
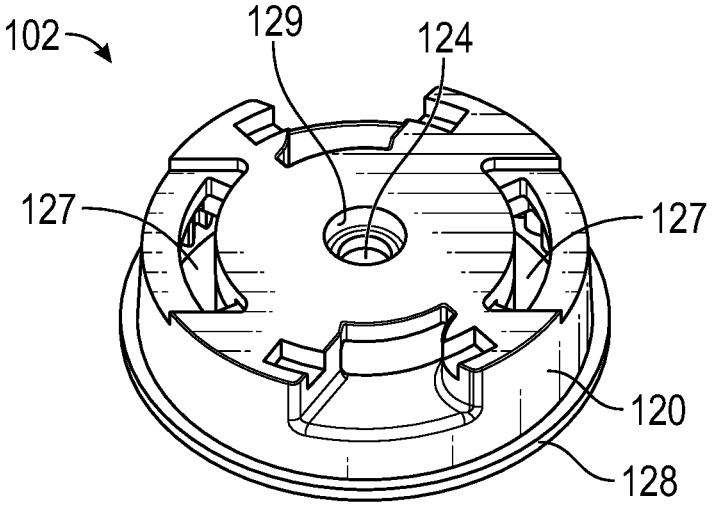
FIG. 10 is a bottom perspective view of the housing.
Figure 11:
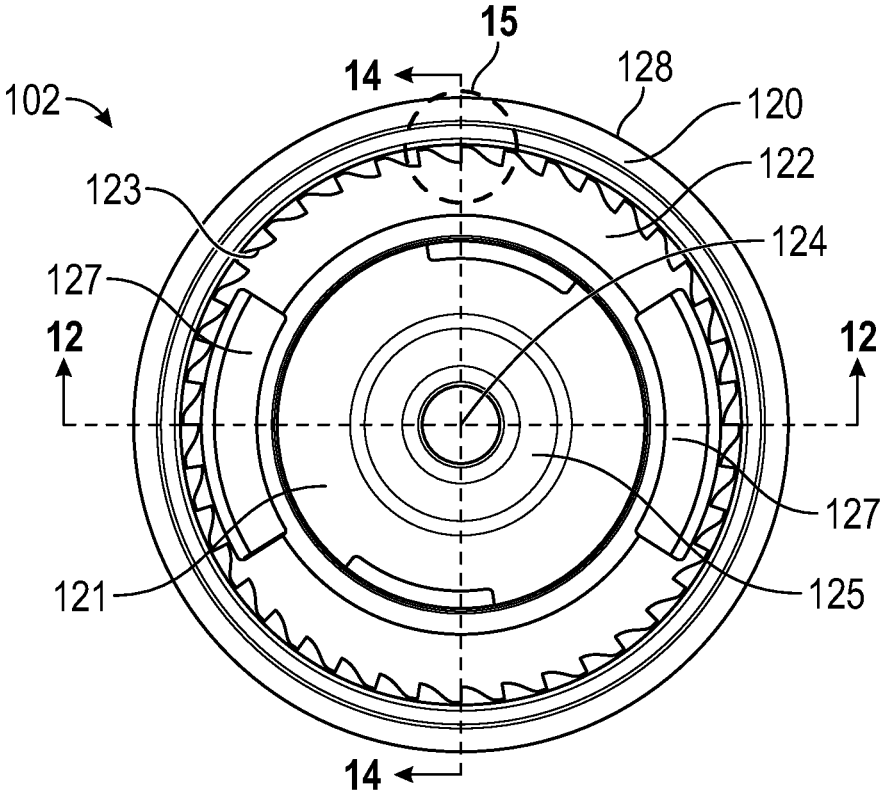
FIG. 11 is a top plan view of the housing.
Figure 12:
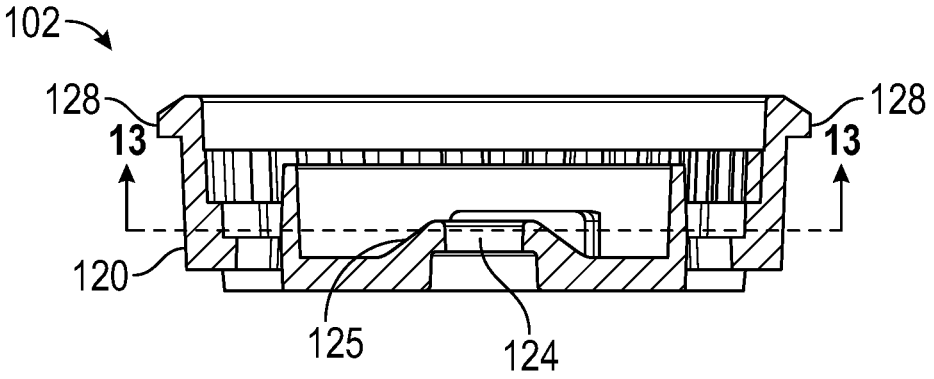
FIG. 12 is a cross-sectional view taken of the housing along line 12-12 of FIG. 11.
Figure 13:
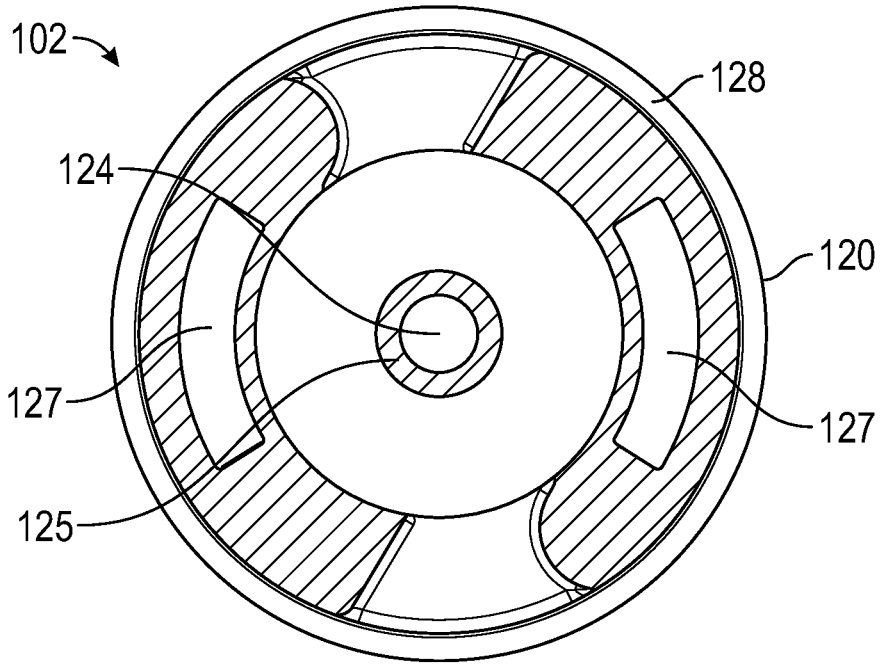
FIG. 13 is a cross-sectional view of the housing taken along line 13-13 of FIG. 12.
Figure 15:
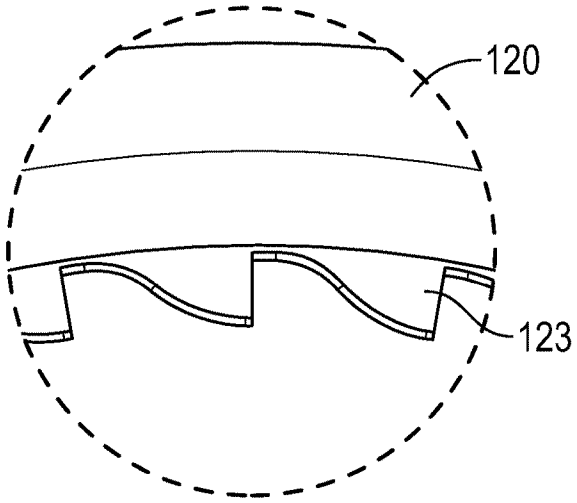
FIG. 15 is an enlarged view of a plurality of teeth of the housing shown in FIG. 11.
Figure 16:
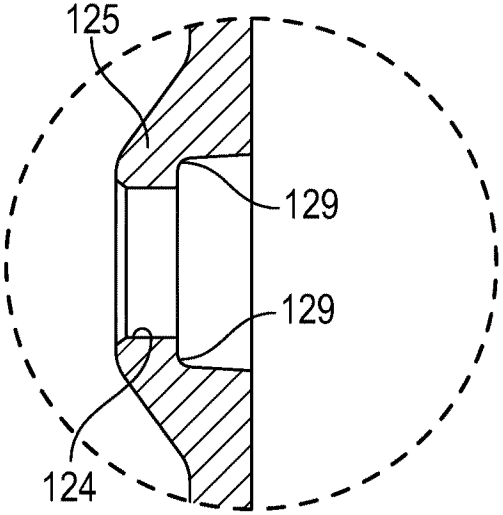
FIG. 16 is an enlarged view of a keyway of the housing shown in FIG. 14.
Figure 14:
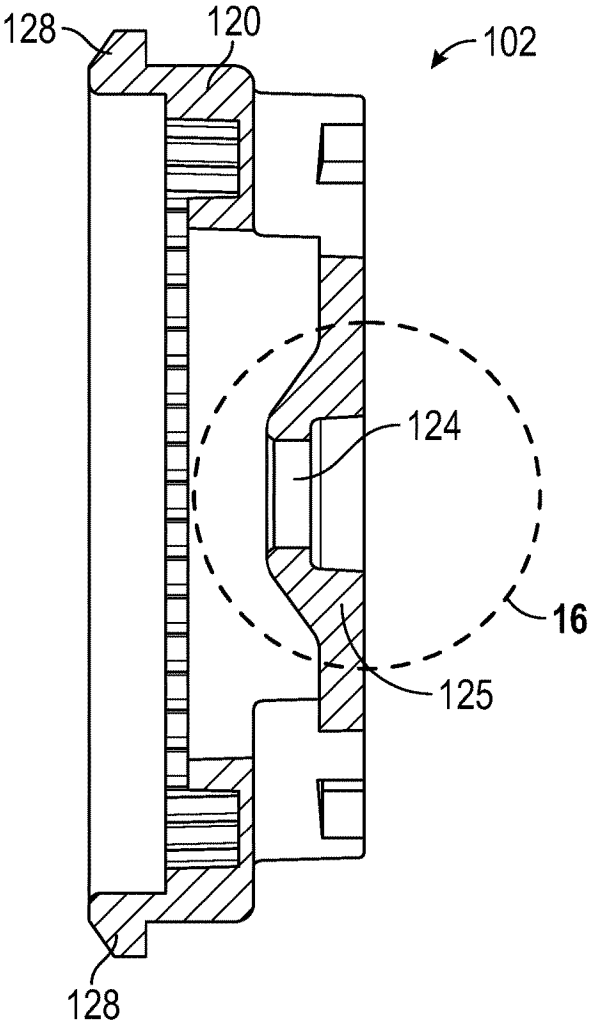
FIG. 14 is a cross-sectional view taken along line 14-14 of FIG. 11.
Figure 17:
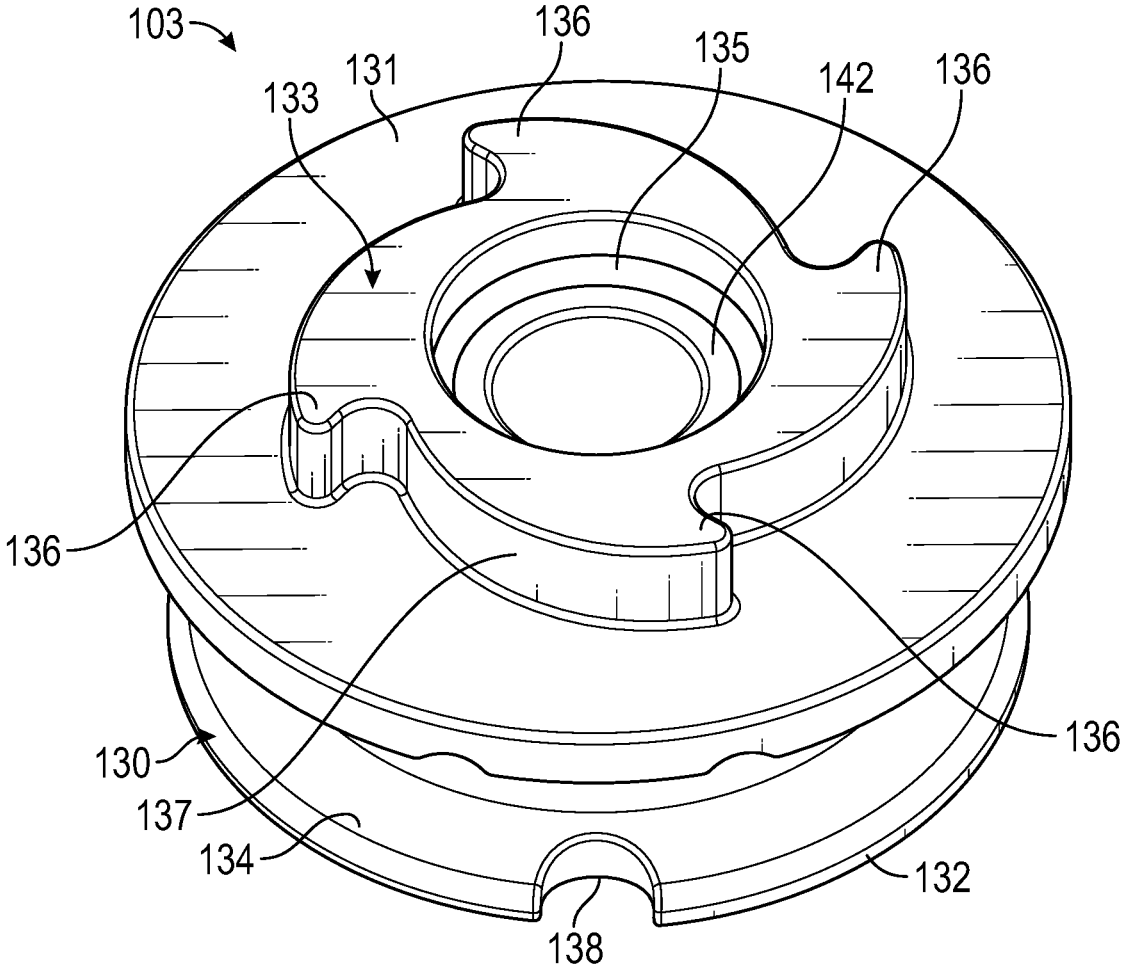
FIG. 17 is a top perspective view of a spool component for the rotary closure of FIG. 1.
Figure 18:
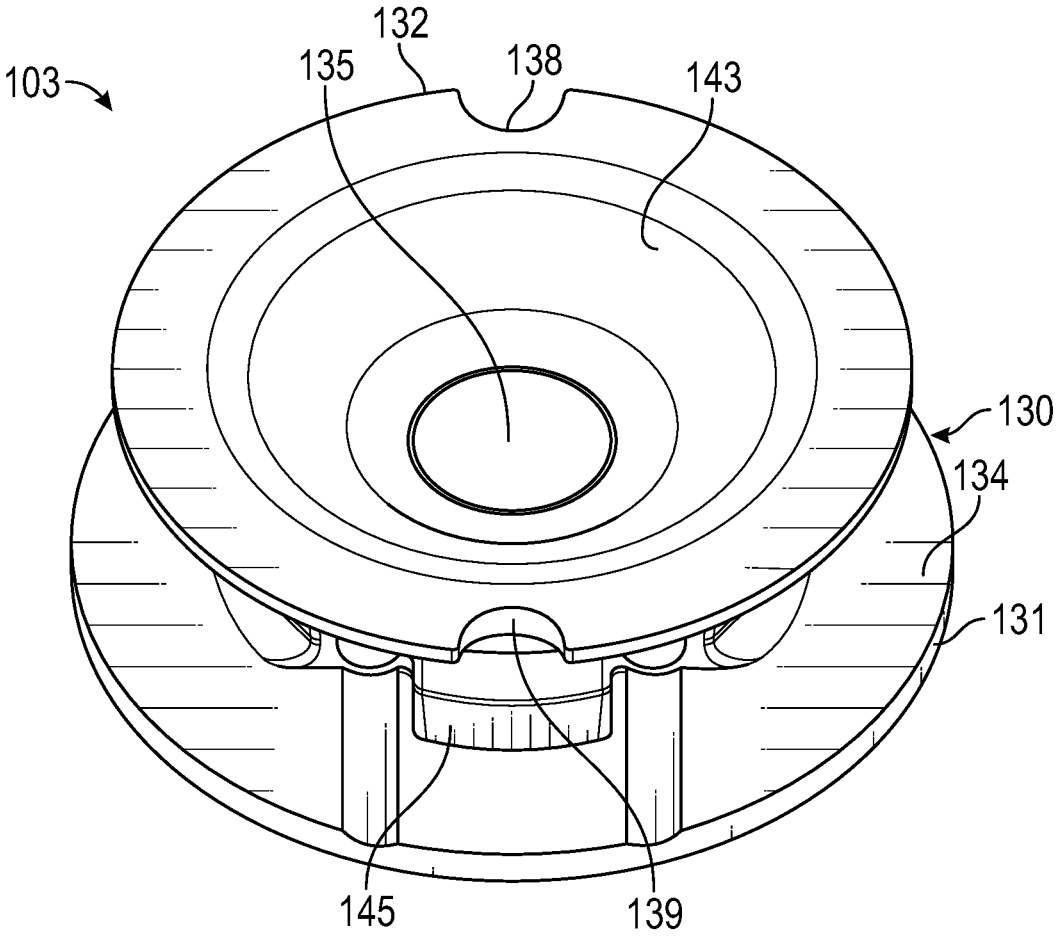
FIG. 18 is a bottom perspective view of the spool component.
Figure 19:
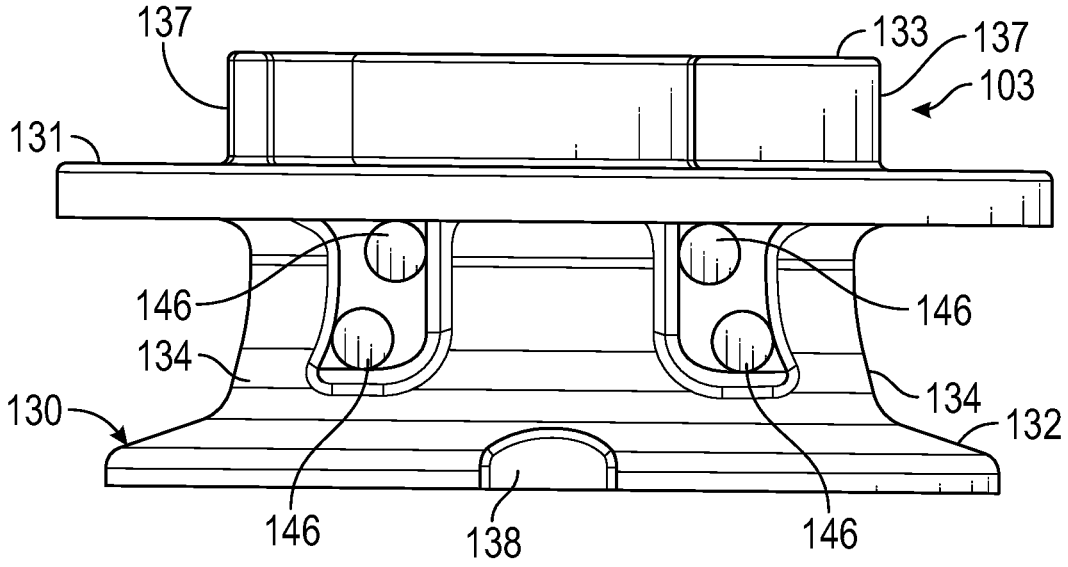
FIG. 19 is a side view of the spool component.
Figure 20:
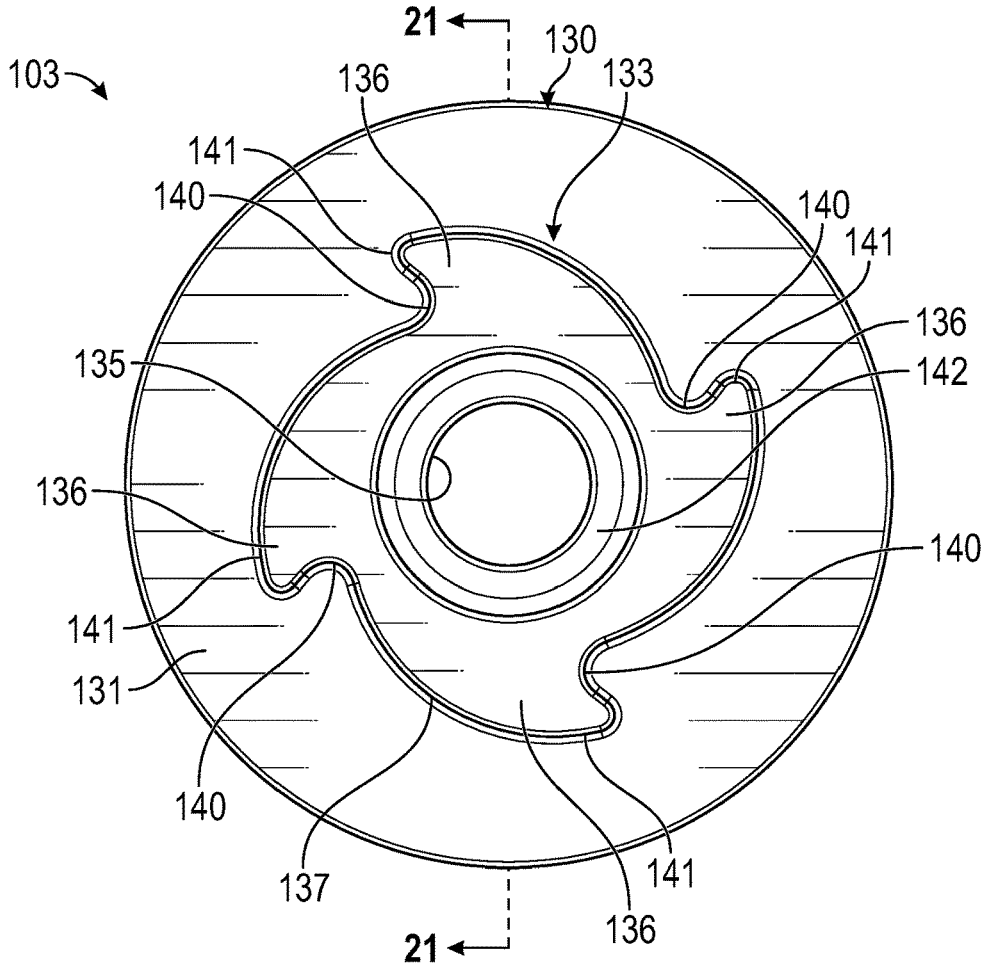
FIG. 20 is a top plan view of the spool component.
Figure 21:
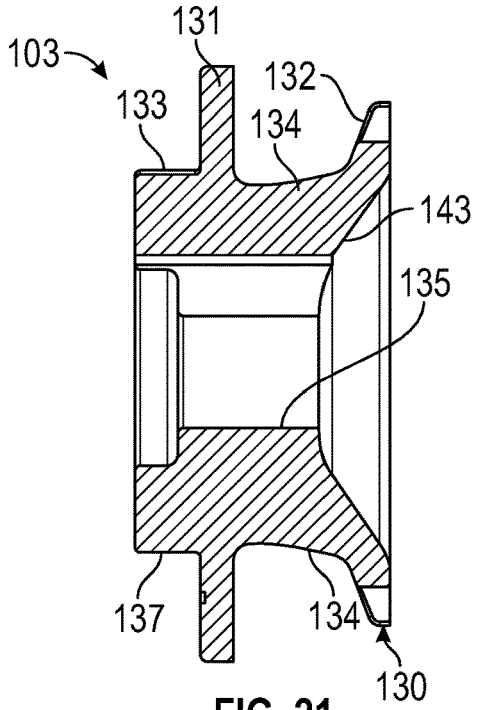
FIG. 21 is a cross-sectional view of the spool component taken along line 21-21 of FIG. 20.

FIGS. 9-16 illustrate the housing 102 for the rotary closure 100. In some embodiments, the housing 102 forms a generally circular body 120 defining an inner casing 121 formed coaxially within an outer casing 122. As shown in FIG. 11, a plurality of teeth 123 is formed circumferentially around the inner side wall of the body 120 below a circumferential flange 128 formed adjacent the outer casing 122. The teeth 123 are configured to operatively engage the snap spring assembly 104 as the dial component 105 is caused to incrementally rotate in one rotational direction only as shall be described in greater detail below. As further shown, a keyway extension 125 extends upwardly within the inner casing 121 and defines the distal-most keyway 124 axially formed through the body 120 that is configured to engage the latching element 187 of the latching extension 186 when latching together the components of the rotary closure 100. As shown in FIGS. 10 and 16, distal-most keyway 124 forms a shoulder 129 defined circumferentially around the keyway 124 that provides a contact surface configured to abut the latching element 187 when the latching element 187 is inserted through the distal-most keyway 124.

In some embodiments, first and second lateral apertures 126 are formed on opposite sides of the distal-most keyway 124, while first and second slots 127 are formed on opposite sides of the distal-most keyway 124 in juxtaposition relative to the first and second lateral apertures 126. The first and second lateral apertures 126 are configured to engage respective first and second retention members 109 and 110 of flange 106 and first and second slots 127 are configured to engage respective first and second engagement members 111 and 112 of flange 106 when coupling the housing 102 to the flange 106 during assembly of the rotary closure 100.

Figure 22:
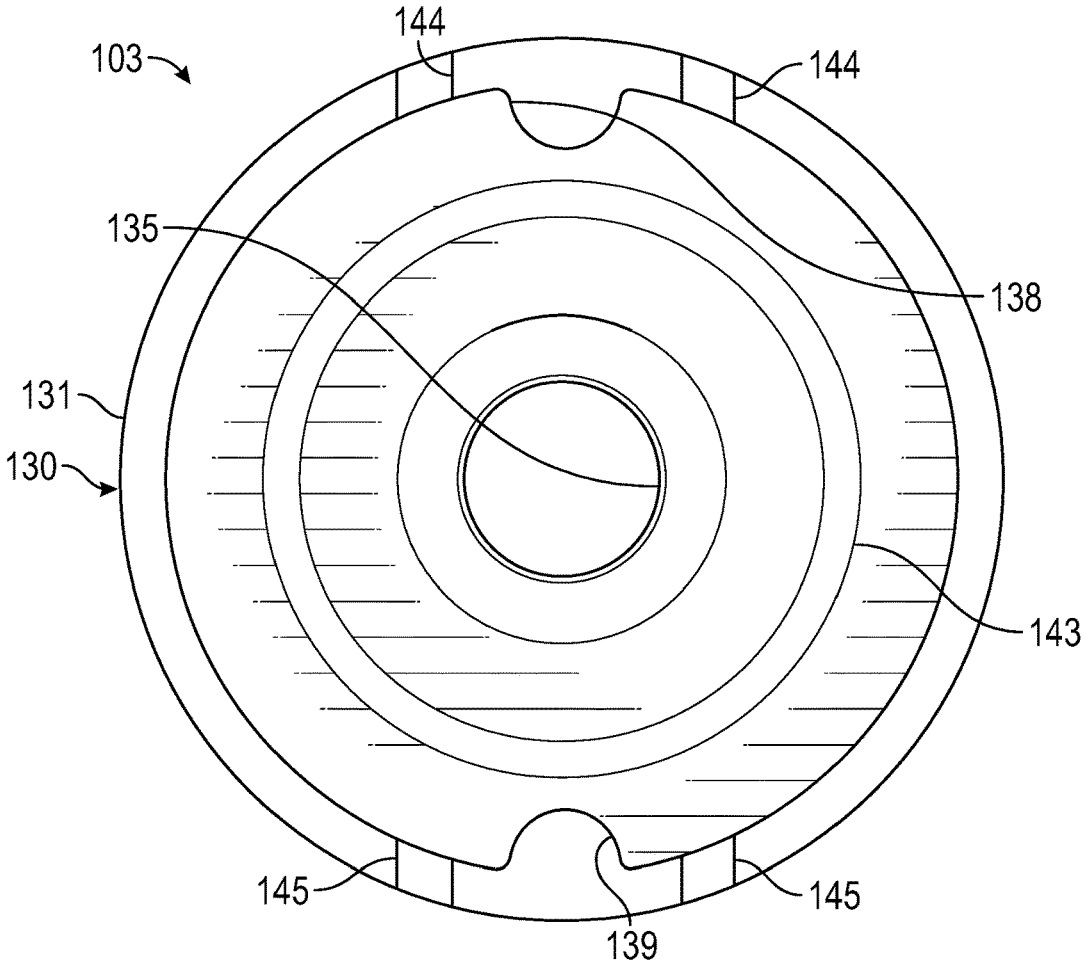
FIG. 22 is a bottom plan view of the spool component.
Figure 23:
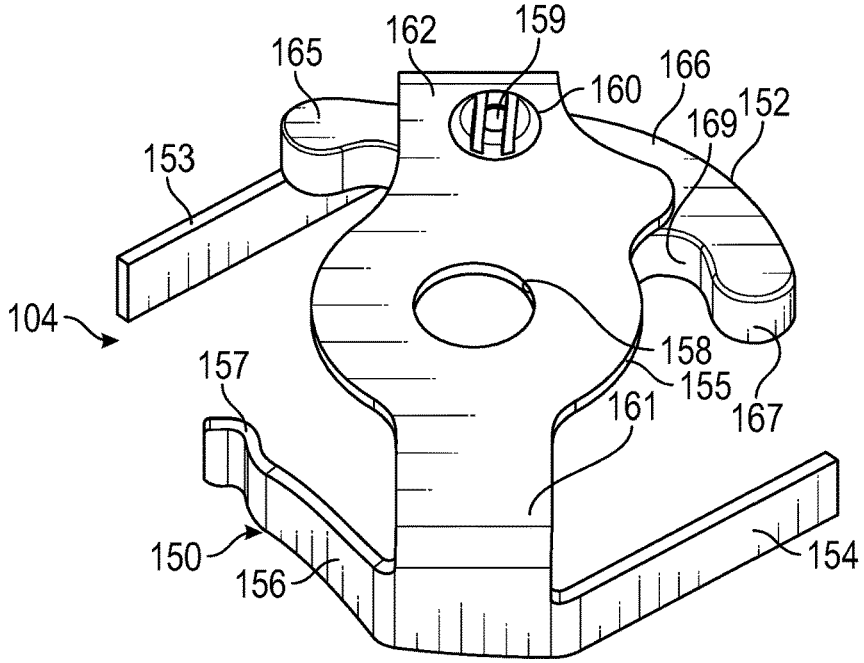
FIG. 23 is a top perspective view of a snap spring assembly for the rotary closure of FIG. 1.
Figure 24:
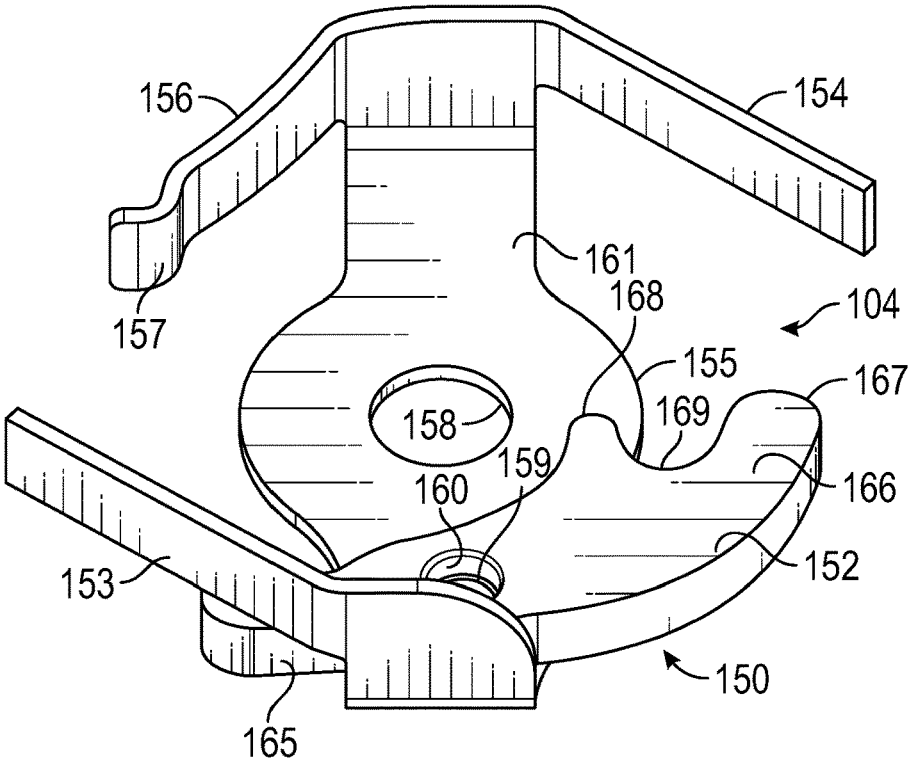
FIG. 24 is a bottom perspective view of the snap spring assembly.

Referring to FIGS. 17-22, the spool component 103 controls the operation of a tensioning element 146 (FIG. 19), such as a cable or wire, used to lace a shoe (not shown) by operation of the rotary closure 100 and is seated within the inner casing 121 of housing 102. In some embodiments, the spool component 103 includes a body 130 forming a base 132 and a flange 131 that collectively define a channel 134 and an extension 133 that extends axially from the flange 131. The extension 133 forms a plurality of curved teeth 136 that collectively form a plurality of recesses 140 in juxtaposition between respective ridges 141 formed circumferentially around the peripheral edge 137 of extension 133. The curved teeth 136 are configured to operatively engage the snap spring assembly 104 for turning the spool component 103 in a particular rotational direction. The spool component 103 defines a keyway 135 axially through body 130 and in co-axial alignment and communication with the distal-most keyway 124 when the spool component 103 is disposed within the housing 102. As shown in FIG. 22, the keyway 135 is formed axially through a well portion 143 and defines an inner shoulder 142 configured to permit passage of the latching element 187. The base 132 further defines a first arcuate slot 138 formed opposite a second arcuate slot 139 around the circumferential edge of the base 132. The first and second arcuate slots 138 and 139 are each configured to permit passage of the tensioning element 146 from the spool component 103 when the spool component 102 is engaged within the inner casing 121 of the housing 102 during assembly of the rotary closure 100. As further shown, a first pair of windows 144 are formed through one side of the base 132, while a second pair of windows 145 are formed through an opposite side of the base 132. Structurally, the first and second pairs of windows 144 and 145 are configured to allow passage of the tensioning element 146 wound around the spool component 103 during operation of the rotary closure 100.

Figure 25:
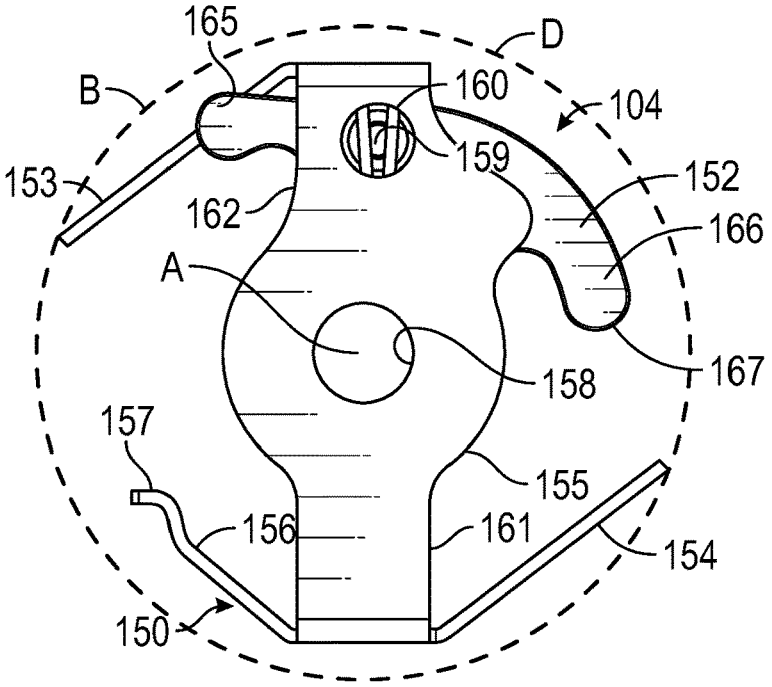
FIG. 25 is a top plan view of the snap spring assembly.
Figure 26:
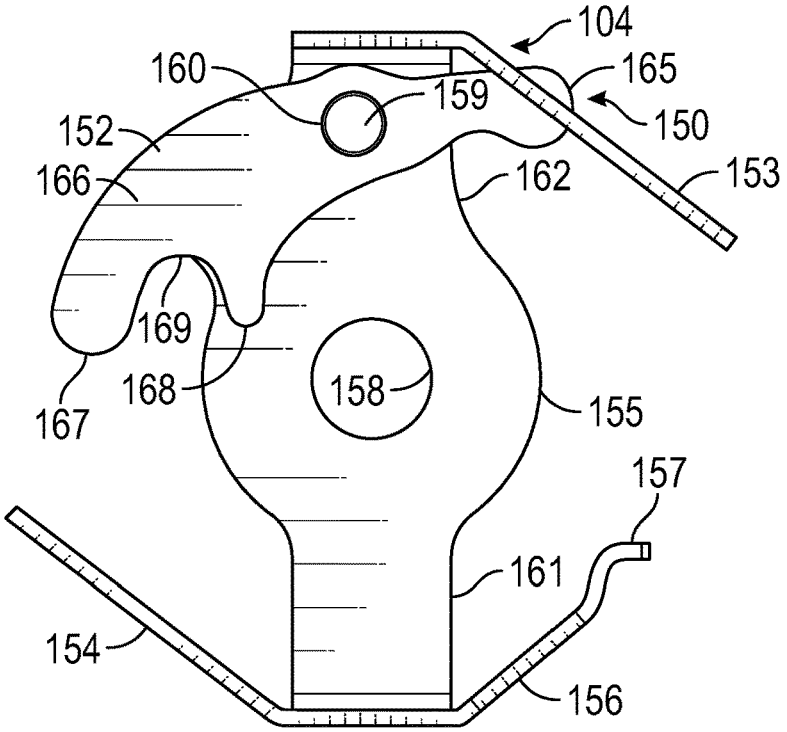
FIG. 26 is a bottom plan view of the snap spring assembly.
Figure 27:
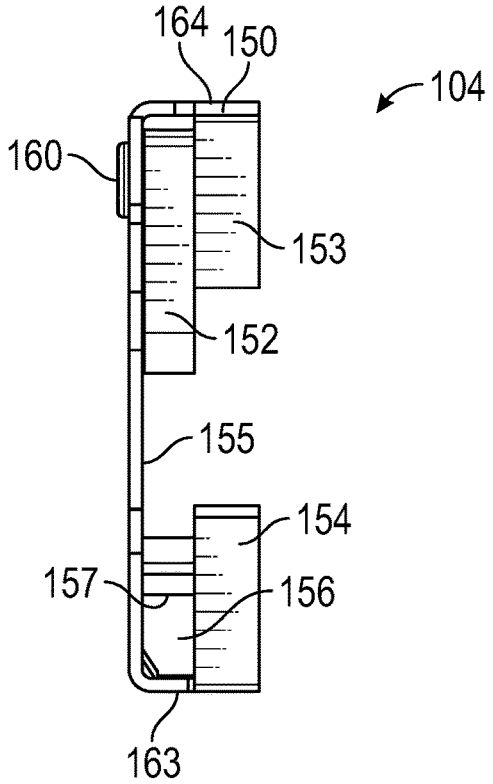
FIG. 27 is a side view of the snap spring assembly.
Figure 28:
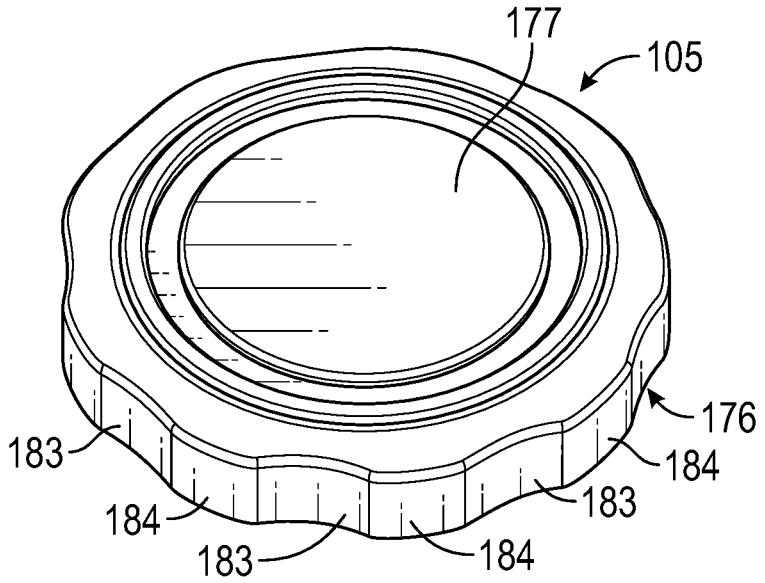
FIG. 28 is a top perspective view of a dial component for the rotary closure of FIG. 1.

Referring to FIGS. 23-27, the snap spring assembly 104 includes a body 150 having a center portion 155 forming a first lateral arm 161 and an opposite second lateral arm 162. A pivot element 160 is engaged through the second lateral arm 162 and a pawl member 152 pivots or rotates about a pivot axis 159 through rotation of pivot element 160. In some embodiments, the pawl member 152 defines a proximal portion 165 and an opposite distal portion 166 in which the distal portion 166 forms a first ridge 167 and a second ridge 168 with a recess 169 defined between ridges 167 and 168. In operation, the pawl member 152 is in operative engagement with the extension 133 to control rotation of the spool component 103. For example, the recess 169 of the pawl member 152 is configured to engage a respective ridge 141 of the extension 133 such that the rotation of the spool component 103 is controlled by the pawl member 152. The snap spring assembly 104 includes a first spring portion 153 and second spring portion 154 which are configured to incrementally engage the plurality of teeth 114 of housing 102 as the dial component 105 is rotated by the user. In addition, a third spring member 156 forms a terminal end portion 157 that also engages the plurality of teeth 123 such that counter rotation of the snap spring assembly 104 is prevented if the dial component 105 is rotated in the opposite rotational direction by the user. The snap spring assembly 104 is further configured such that the first, second, and third spring portions 153, 154 and 156 extend outwardly to a circumference D as illustrated in FIG. 25. As shown, a keyway 158 is formed axially through the central portion of the snap spring assembly 104 along axis A and is in coaxially aligned with keyways 135 and 179.

Figure 29:
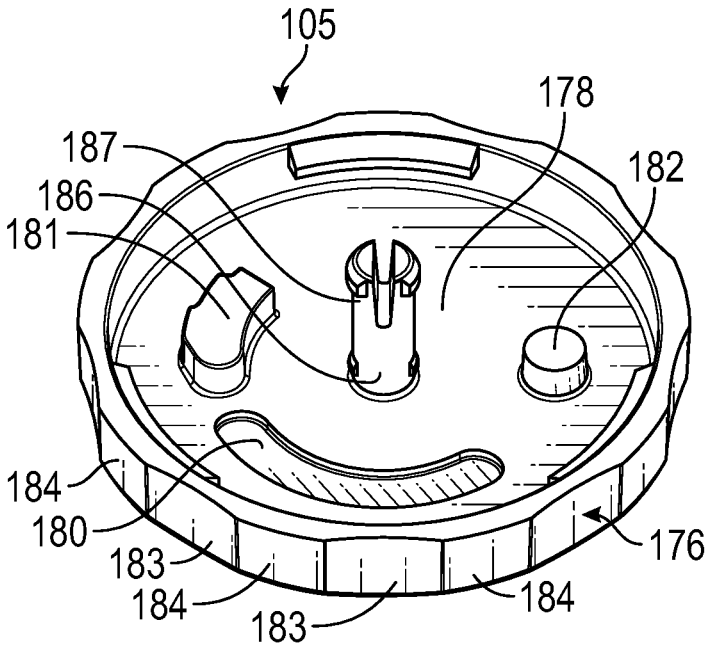
FIG. 29 is a bottom perspective view of the dial component.
Figure 30:
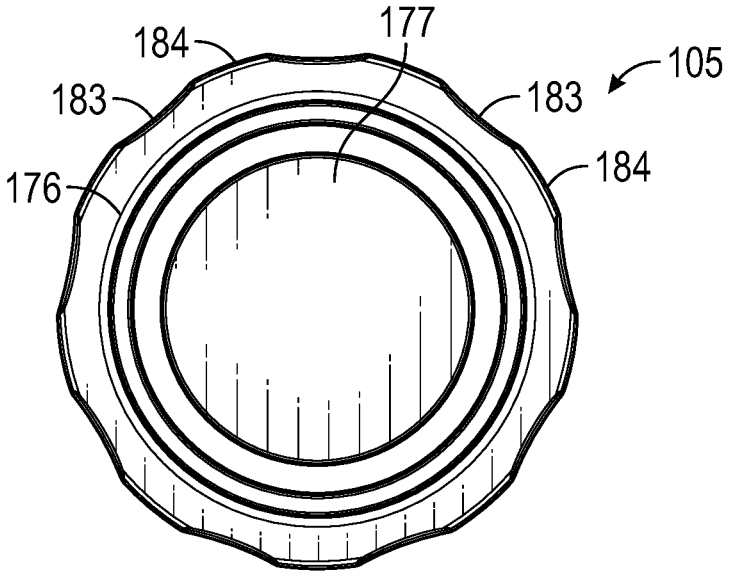
FIG. 30 is a top plan view of the dial component.
Figure 31:
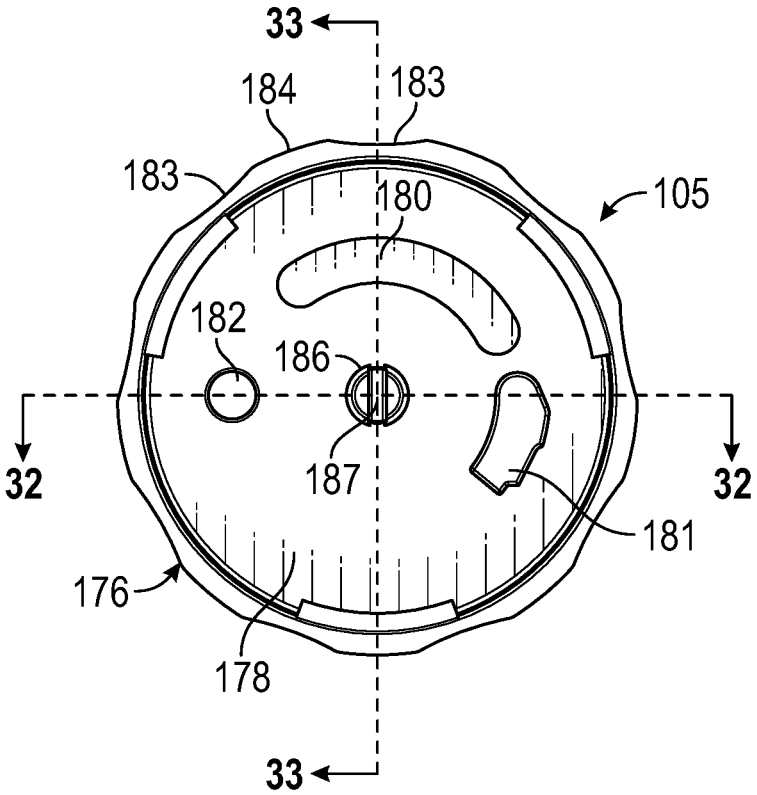
FIG. 31 is a bottom plan view of the dial component.

Referring to FIGS. 28-34, the dial component 105 provides a means for actuating the rotary closure 100 through manual rotation of the dial component 105 along one rotational direction. In some embodiments, the dial component 105 includes a body 176 defining an exterior surface 177 and an interior surface 178. In some embodiments, the exterior surface 177 forms a plurality of gripping recesses 183 interposed between and in juxtaposition with a plurality of gripping ridges 184 that collectively form a gripping surface configured for gripping by the hand of the user where rotating the dial component 105. In some embodiments as shown in FIGS. 29 and 31, the interior surface 178 forms a raised extension 181 and a post extension 182 in which the post extension 182 is configured to engage with the pawl member 152 as the pawl member 152 is caused to pivot. As shown, a curved recess 180 is formed along the interior surface 180 of the dial component 105 and defines a clearance area that permits the pivot element 160 of the snap spring assembly 104 to freely move along during operation of the rotary closure 100.

Figure 32:
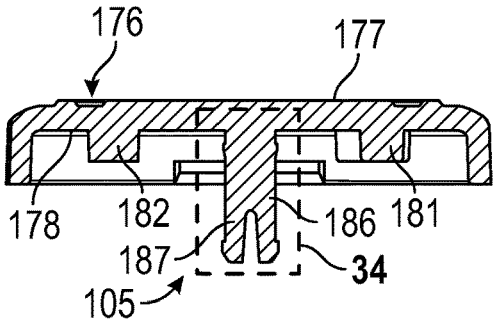
FIG. 32 is a cross-sectional view of the dial component taken along line 32-32 of FIG. 31.
Figure 33:
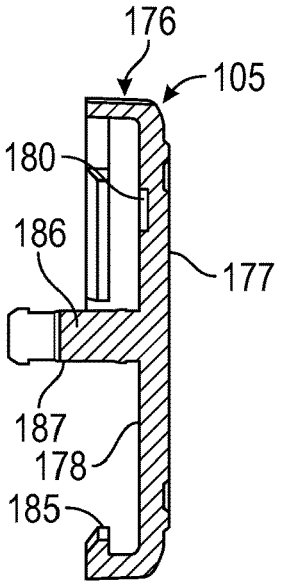
FIG. 33 is a cross-sectional view of the dial component taken along line 33-33 of FIG. 31.
Figure 34:
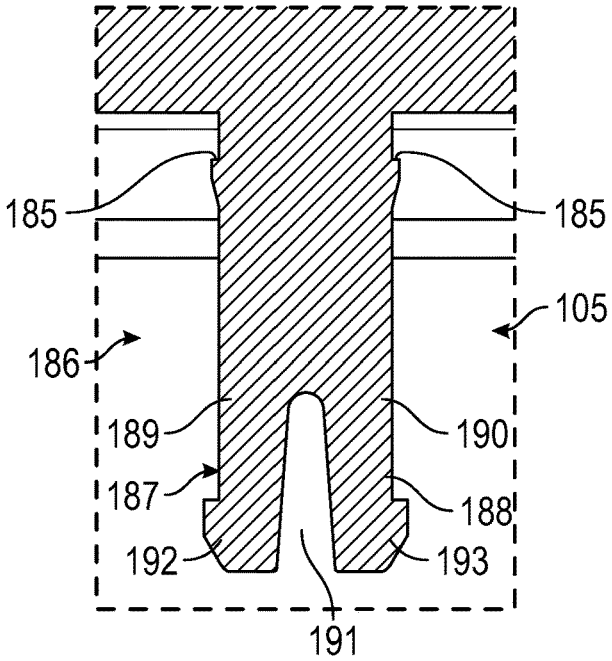
FIG. 34 is an enlarged cross-sectional view of the dial component of FIG. 32.

Referring to FIGS. 32-34, as noted above the latching extension 186 formed at the free end of the latching element 187 that extends axially outward from the dial component 105 provides a structural element configured to be inserted through co-axially aligned keyways 124, 135 and 158 (FIG. 3) of the snap spring assembly 104, spool component 103, and housing 102, respectfully. As shown, the latching extension 186 forms a ridge 185 at least partially around the circumference thereof which communicates with the latching element 187 that is configured to engage the housing 102 once the latching element 187 is fully inserted through the distal-most keyway 158 of housing 102. In some embodiments, the latching element 187 forms a bifurcated tab portion 188 defining a first leg 189 and a second leg 190 with a slot 191 defined between the first and second legs 189 and 190. In some embodiments, a first tang 192 is formed at the free end of the first leg 189 and a second tang 193 is formed at the free end of the second leg 190. In some embodiments, the bifurcated tab portion 188 is made from a durable and flexible plastic material that allows the first and second legs 189 and 190 to flex inward toward the slot 191 when a force is applied to the latching element 187. During a latching operation, the latching extension 186 is inserted fully through the aligned keyways 124, 135 and 158 until the bifurcated tab 188 extends through the distal-most keyway 158 such that the first and second legs 189 and 190 are forced together by narrower width of the distal-most keyway 158. As the first and second legs 189 and 190 are forced together, the first and second tangs 192 and 193 become engaged with the shoulder 129 of the keyway 158 in a snap fit engagement such that the latching extension 186 latches together the snap spring assembly 104, spool component 103, and housing 102, and dial component 105 to form an assembled rotary closure 100 that may now be coupled with the flange 106 which is already secured to a shoe as discussed above.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A latching system for a rotary closure, comprising:

a housing defining a body, the body defining an outer casing co-axially surrounding an inner casing with a distal-most keyway formed along a longitudinal axis of the housing;

a spool component disposed within the housing, the spool component defining a first keyway formed through the spool component and in co-axial alignment and in communication with the distal-most keyway of the housing;

a snap spring assembly in operative engagement with the spool component and disposed within the housing for controlling a direction of rotation of the spool component, the snap spring assembly defining a second keyway formed through the snap spring assembly and in co-axial alignment and in communication with the first keyway; and a dial component in operative engagement with the snap spring assembly for rotating the spool component, the dial component comprising an exterior surface and an interior surface, the interior surface defining a latching extension, wherein the latching extension defines a free end comprising a latching element, the latching element defining a first leg having a first tang and a second leg having a second tang, wherein a slot is defined between the first leg and second leg, wherein the latching extension is configured to be inserted in co-axial alignment through the second keyway of the snap spring assembly, the first keyway of the spool component, and the distal-most keyway of the housing such that the latching extension is coupled with the distal-most keyway.

2. The latching system of claim 1, further comprising:

a flange defining a circular body with a bowed cross section, wherein the flange defines a receptacle, wherein the receptacle is configured to engage the housing of the latching system.

3. The latching system of claim 1, wherein the first leg and the second leg are forced together as the latching extension is inserted through the distal-most keyway of the housing and wherein the first tang and the second tang engage a shoulder of the distal-most keyway in a snap fit engagement.

4. The latching system of claim 1, further comprising:

a plurality of teeth defined circumferentially around the inner casing of the housing, wherein the plurality of teeth are configured to operatively engage the snap spring assembly.

5. The latching system of claim 1, wherein the spool component engages the snap spring assembly by a plurality of curved teeth extending from a spool extension defined by the spool component, wherein the spool component is configured to control the operation of a tensioning element.

6. The latching system of claim 5, wherein the snap spring assembly includes a pawl member operative to engage the spool component, wherein the pawl member engages with one of the plurality of curved teeth of the spool extension and wherein the pawl member of the snap spring assembly controls the rotation of the spool component.

7. The latching system of claim 6, wherein the interior surface of the dial component further comprises a post extension, wherein the post extension is operable to engage the pawl member of the snap spring assembly, wherein the dial component is operable to rotate the pawl member of the snap spring assembly when the dial component is rotated.

8. The latching system of claim 7, wherein the snap spring assembly and the housing remain in a fixed angular position relative to the dial component and the spool component.

9. The latching system of claim 7, wherein the spool component is operable to wind the tensioning element such that variable tension is applied to the tensioning element by manually rotating the dial component.

10. The latching system of claim 5, wherein a spring member of the snap spring assembly engages one of the plurality of curved teeth of the spool extension such that counter-rotation of the spool component is prevented.

11. The latching system of claim 1, wherein the exterior surface of the dial component defines a gripping surface such that the dial component is configured to be gripped and rotated by the hand of the user.

12. A method for assembling a latching system of a rotary closure, comprising:

engaging a snap spring assembly with a spool component, wherein the snap spring assembly and spool component are disposed within a housing;

inserting a latching extension having a bifurcated tab portion defining a first leg and a second leg through a plurality of coaxially aligned keyways, wherein the first leg and the second leg of the latching extension are forced together as they are pushed into a distal-most keyway of the plurality of coaxially aligned keyways, wherein the latching extension extends axially from the center of a dial component; and inserting the latching extension through the distal-most keyway such that the bifurcated tab portion of the latching extension extends through the distal-most keyway, wherein a first tang defined by the first leg and a second tang defined by the second leg engage with a shoulder of the distal-most keyway in a snap fit engagement such that the housing, the snap spring assembly, the spool component, and the dial component are latched together.

13. The method of claim 12, further comprising:

engaging the housing with a flange, wherein a receptacle of the flange engages with the housing using a first retention member and a second retention member in a snap fit engagement, and wherein the flange is attached to a shoe.

14. The method of claim 12, wherein the spool component comprises:

a tensioning element, wherein the tensioning element is wound around the spool component; and a spool extension, wherein the spool extension defines a plurality of curved teeth.

15. The method of claim 14, further comprising:

applying tension to the tensioning element of the spool component by turning the dial component, wherein a post extension of the dial component is configured to engage a pawl member of the snap spring assembly, and wherein the pawl member of the snap spring assembly is configured to engage one of the plurality of curved teeth of the spool extension.

16. The method of claim 15, wherein the rotation of the dial component drives the rotation of the pawl member of the snap spring assembly and wherein the rotation of the pawl member drives the rotation of the spool component, wherein the rotation of the spool component applies tension to the tensioning element wound around the spool component.

17. A latching system for a rotary closure, comprising:

a dial component defining an interior surface, wherein the dial component is configured for manual rotation;

a latching extension having a free end, wherein the latching extension extends axially from the interior surface of the dial component;

a latching element formed at the free end of the latching extension, the latching element defining a first leg having a first tang and a second leg having a second tang, wherein a slot is defined between the first leg and second leg; and a distal-most keyway defined axially through a housing, wherein the distal-most keyway of the housing defines a shoulder;

wherein the first leg and the second leg of the latching element are forced together as the latching extension is inserted through the distal-most keyway of the housing and wherein the first tang and the second tang engage with the shoulder of the distal-most keyway in a snap fit engagement.

18. The latching system of claim 17, further comprising a spool component having a first keyway and a snap spring assembly having a second keyway, wherein the latching element is configured to be inserted through the first keyway and the second keyway before being inserted through the distal-most keyway of the housing such that the first keyway, the second keyway and the housing are co-axially aligned.

19. The latching system of claim 18, wherein the first tang and the second tang of the latching element are engaged with the housing such that the snap spring assembly, the spool component, the dial component, and the housing are latched together.

* * * * *